US009323182B2

(12) United States Patent
Makino et al.

(10) Patent No.: US 9,323,182 B2
(45) Date of Patent: Apr. 26, 2016

(54) IMAGE FORMING APPARATUS

(71) Applicant: CANON KABUSHIKI KAISHA, Tokyo (JP)

(72) Inventors: Masahiro Makino, Tsukubamirai (JP); Masami Hano, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/714,755

(22) Filed: May 18, 2015

(65) Prior Publication Data

US 2015/0338790 A1 Nov. 26, 2015

(30) Foreign Application Priority Data

May 20, 2014 (JP) ..... 2014-103975

(51) Int. Cl.
*G03G 15/01* (2006.01)
*G03G 15/16* (2006.01)

(52) U.S. Cl.
CPC ..... *G03G 15/1615* (2013.01)

(58) Field of Classification Search
CPC ..... G03G 15/1615
See application file for complete search history.

(56) References Cited

U.S. PATENT DOCUMENTS 6,724,410 B2 4/2004 Arai
6,799,010 B2 9/2004 Namiki
7,085,520 B2 * 8/2006 Yamada ..... G03G 15/0121 399/227
8,050,582 B2 11/2011 Aiba
8,417,134 B2 * 4/2013 Hosohara ..... G03G 21/181 399/110
2014/0314431 A1 * 10/2014 Morihara ..... G03G 15/1615 399/46

FOREIGN PATENT DOCUMENTS

JP 2002-196560 A 7/2002
JP 2003-043770 A 2/2003
JP 2009-139670 A 6/2009

* cited by examiner

*Primary Examiner* — David Gray
*Assistant Examiner* — Michael Harrison
(74) *Attorney, Agent, or Firm* — Fitzpatrick, Cella, Harper & Scinto

(57) ABSTRACT

An image forming apparatus includes: a belt; a first image forming unit including a first drum; a second image forming unit including a second drum; a contact-and-separation portion; an executing portion; and a controller for rotating the second drum by a predetermined angle so that when a cycle of an operation is to be repeated N times, a position of the second drum contacting the belt in an (N−1)th cycle differs from a position of the second drum contacting the belt in an Nth cycle, the cycle including receiving the image data in a state that the belt and the first and second drums are at rest and in a stand-by state that the image forming apparatus waits for an input of the image data in the first state, executing the image forming operation, and then returning the image forming apparatus to the stand-by state.

14 Claims, 7 Drawing Sheets

IMAGE FORMING APPARATUS

FIELD OF THE INVENTION AND RELATED ART

The present invention relates to an image forming apparatus using an intermediary transfer belt.

An image forming apparatus of an intermediary transfer type in which a plurality of photosensitive drums are provided in contact with the intermediary transfer belt and toner images different in color are formed on the plurality of photosensitive drums and then are transferred onto the intermediary transfer belt has been widely used. Further, an image forming apparatus of a tandem type in which a plurality of photosensitive drums are provided in contact with a recording material feeding belt and toner images different in color are formed on the plurality of photosensitive drums and then are transferred onto a recording material on the recording material feeding belt has also been widely used. In these full-color image forming apparatuses using the belt members, in general, black (single color) image formation for forming a monochromatic image by using only the photosensitive drum for black is executable.

Japanese Laid-Open Patent Application 2003-043770 discloses an image forming apparatus in which when black image formation (mode) is selected, photosensitive drums for yellow, magenta and cyan which are not used are separated (spaced) from the intermediary transfer belt. Japanese Laid-Open Patent Application 2009-139670 discloses an image forming apparatus in which when black image formation is selected, the intermediary transfer belt is spaced from the photosensitive drums for yellow, magenta and cyan which are not used.

In the image forming apparatus capable of executing the black image formation by spacing the photosensitive drums for yellow, cyan and magenta from the intermediary transfer belt, it was proposed that a full-color stand-by mode and a black (single color) stand-by mode are switchably settable. As described above, in the full-color stand-by mode, the image forming apparatus is in a stand-by state for image formation in a state in which the photosensitive drums for yellow, magenta, cyan and black are contacted to the intermediary transfer belt, and therefore the image forming apparatus has such an advantage that full-color image formation can be executed immediately.

However, it turned out that when the black image formation is repetitively executed in a state in which the mode of the image forming apparatus is set at the full-color stand-by mode, a line-shaped density non-uniformity with respect to a main-scan direction of the photosensitive drum generates on an output image by subsequently executed full-color image formation. That is, in a first stand-by mode in which a first image bearing member and a second image bearing member are contacted to the belt member and the image forming apparatus is on stand-by for image formation, when image formation effected in a state in which the second image bearing member is spaced from the belt member is repetitively effected, it turned out that density non-uniformity generates on an output image obtained by using the second image bearing member.

SUMMARY OF THE INVENTION

According to an aspect of the present invention, there is provided an image forming apparatus comprising: a movable belt member; a first image forming unit, including a rotatable first image bearing drum, for forming a toner image on the belt member; a second image forming unit, including a rotatable second image bearing drum, for forming a toner image on the belt member; a contact-and-separation portion capable of setting either one of a plurality of states including a first state in which the belt member is in contact with the first and second image bearing drums and a second state in which the belt member is in contact with the first image bearing drum and is in separation from the second bearing drum; a an executing portion capable of executing an operation in a mode in which when image data is received, the second state is set and in a state in which the second image bearing drum is at rest, the toner image is formed on the belt member by the first image forming unit and then is transferred onto a recording material; and a controller for rotating the second image bearing drum by a predetermined angle so that when a cycle of an operation is to be repeated N times which is not less than 1, a position of the second image bearing drum which is in contact with said belt member in an (N−1)th cycle differs from a position of the second image bearing drum which is in contact with said belt member in an Nth cycle, the cycle including receiving the image data in a state that said belt member and the first and second image bearing drums are at rest and in a stand-by state that said image forming apparatus waits for an input of the image data in the first state, executing the image forming operation, and then returning said image forming apparatus to the stand-by state.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be described in detail with reference to the drawings.

Embodiment 1

(Image forming apparatus)

Figure 1:
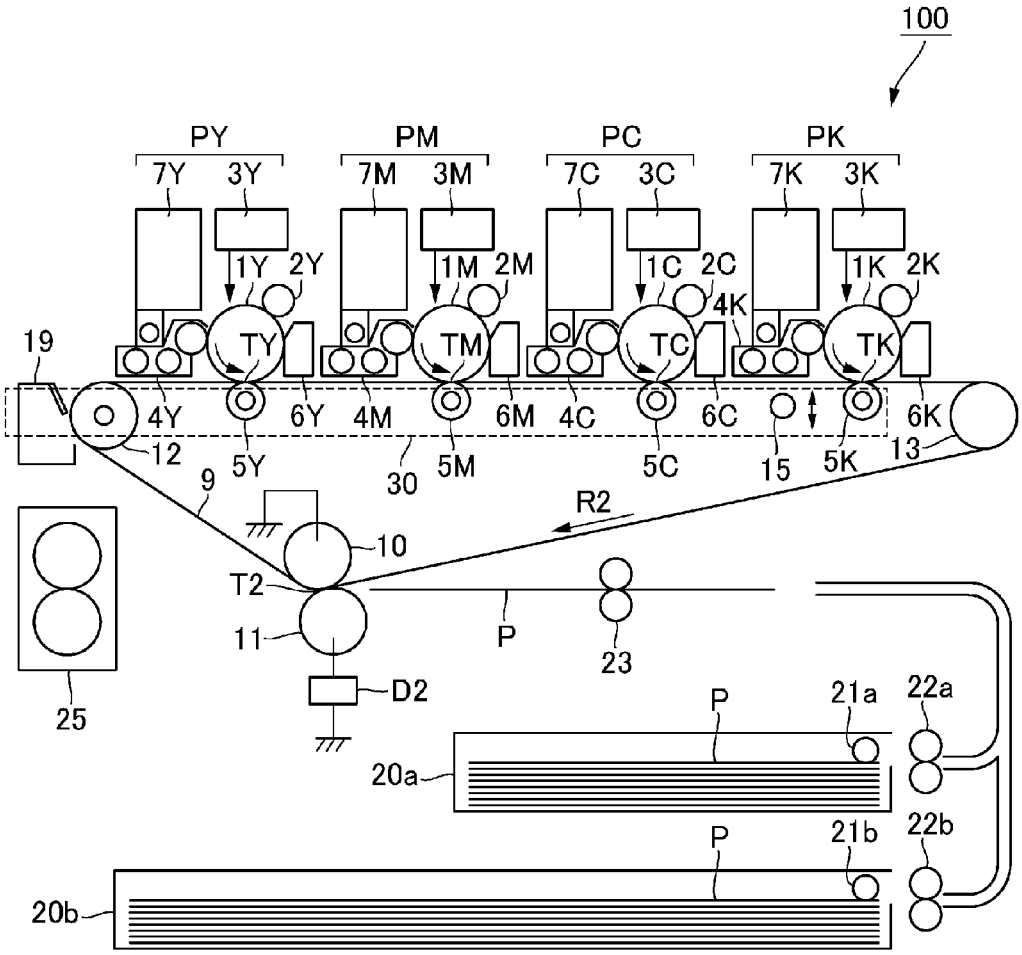
FIG. 1 is an illustration of a structure of an image forming apparatus.

FIG. 1 is an illustration of a structure of an image forming apparatus 100. As shown in FIG. 1, the image forming apparatus 100 is a full-color printer of a tandem type and an intermediary transfer type in which image forming portions PY, PM, PC and PK for yellow, magenta, cyan and black, respectively, are provided and arranged along an intermediary transfer belt 9.

At the image forming portion PY, a yellow toner image is formed on a photosensitive drum 1Y and is transferred onto the intermediary transfer belt 9. At the image forming portion PM, a magenta toner image is formed on a photosensitive drum 1M and is transferred onto the intermediary transfer belt 9. At the image forming portions PC and PK, a cyan toner image and a black toner image are formed on a photosensitive drum 1C and a photosensitive drum 1K, respectively, and are transferred onto the intermediary transfer belt 9.

The four color toner images transferred on the intermediary transfer belt 9 are fed to a secondary transfer portion T2, and are secondary-transferred onto a recording material P. The recording material P is pulled out of a recording material cassette 20*a* by a feeding roller 21*a* and is separated one by one by a separating device 22*a*, and then is sent toward a registration roller pair 23.

The registration roller pair 23 feeds the recording material P to the secondary transfer portion T2 while timing the recording material P to the toner images on the intermediary transfer belt 9. The recording material P on which the four color toner images are secondary transferred is delivered to a fixing device 25, and is heated and pressed, so that the full-color image is fixed on the recording material surface and then the recording material P is discharged to an outside of a casing of the image forming apparatus 100. A belt cleaning device 19 removes a transfer residual toner which passes through the secondary transfer portion T2 and which remains on the intermediary transfer belt 9.

(Image Forming Portion)

Figure 2:
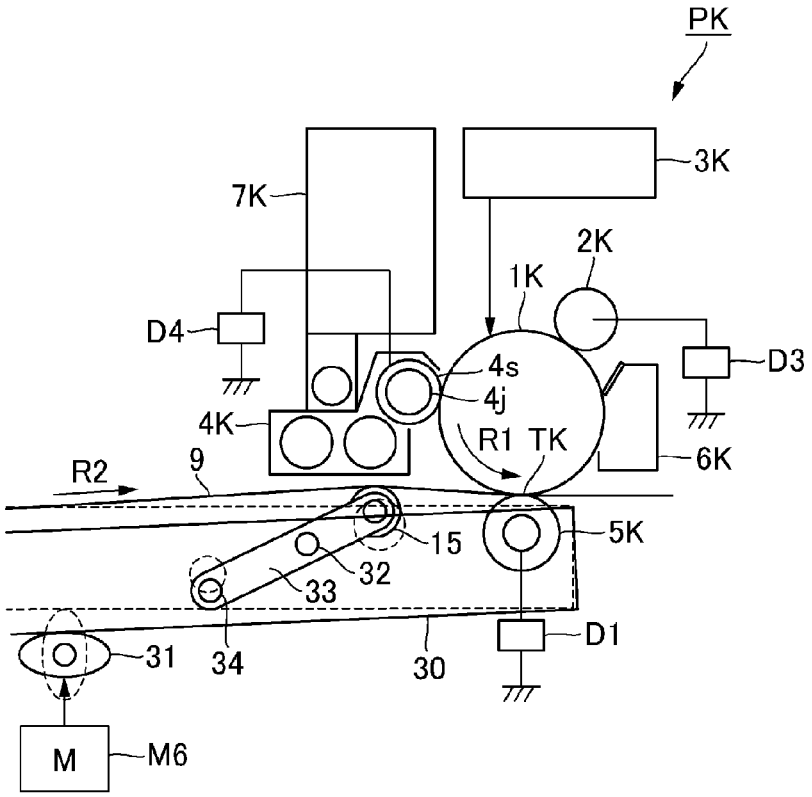
FIG. 2 is an illustration of a structure of an image forming portion.

FIG. 2 is an illustration of structure of the image forming portion. As shown in FIG. 1, the image forming portions PY, PM, PC and PK have the same constitution except that colors of the toners used in developing devices 4Y, 4M, 4C and 4K provided therein, respectively, are different from each other as yellow, magenta, cyan and black, respectively. Therefore, in the following, the black image forming portion PK is described and the image forming portions PY, PM and PC will be omitted from redundant description.

As shown in FIG. 2, at the image forming portion PK, at a periphery of a photosensitive drum 1K, a charging device 2K, an exposure device 3K, the developing device 4K, a transfer roller 5K and a drum cleaning device 6K are provided. The photosensitive drum 1K has a photosensitive layer at a surface thereof and rotates in an arrow R1 direction.

The charging device 2K rotates a charging roller in contact with the photosensitive drum 1K. A power source D3 applies, to the charging roller, a charging voltage in the form of a negative DC voltage biased with an AC voltage, so that the surface of the photosensitive drum 1K is electrically charged uniformly to a negative potential VD.

The exposure device 3K subjects the surface of the photosensitive drum 1K to scanning exposure to a laser beam, through a rotating mirror, obtained by ON-OFF modulating scanning line image data developed from a black color-separated component image. A surface potential of the photosensitive drum 1K charged to the potential VD is lowered to a potential VL by the exposure, so that an electrostatic image for an image is formed on the photosensitive drum 1K.

The developing device 4K stirs a developer (two-component developer) containing a toner and a carrier, thus charging the toner to the negative polarity and charging the carrier to the positive polarity. The developing device 4K carries the developer in an erected state on a developing sleeve 4*s* rotating in the same direction as the rotational direction of the photosensitive drum 1K and rubs the photosensitive drum 1K with the developer. A power source D4 applies, to the developing sleeve 4*s*, a developing voltage in the form of a negative DC voltage biased with an AC voltage, so that the toner is deposited on the electrostatic image, on the photosensitive drum 1K, having the positive polarity relative to the developing sleeve 4*s*. A toner supplying portion 7K supplies, to the developing device 4K, a supply developer in an amount corresponding to an amount of the toner consumed in the developing device 4K.

The transfer roller 5K sandwiches the intermediary transfer belt 9 between itself and the photosensitive drum 1K, thus forming a primary transfer portion TK between the photosensitive drum 1K and the intermediary transfer belt 9. A power source D1 applies a positive DC voltage to the transfer roller 5K, so that the toner image which is negatively charged and carried on the photosensitive drum 1K is primary-transferred onto the intermediary transfer belt 9.

The drum cleaning device 6K rubs the photosensitive drum 1K with a cleaning blade, thus removing a transfer residual toner remaining on the photosensitive drum 1K after passed through the primary transfer portion TK.

(Photosensitive Drum)

The photosensitive drum 1K is an organic photosensitive member which is obtained by forming the following first to fifth layers on an aluminum-made drum substrate of 30 mm in diameter and which has a negative charge polarity.

The first layer is an undercoat layer consisting of a 20 μm-thick electroconductive layer. The first layer smoothens the surface of the aluminum-made drum substrate to eliminate a surface defect or the like. The second layer is a positive charge injection layer consisting of a 1 μm-thick medium-resistance layer. The second layer prevents canceling of the negative charge on the photosensitive drum surface by the positive charge injected from the drum substrate. The second layer is adjusted in resistance to about $10\times10^6$ Ω·cm by AMILAN™ resin and methoxymethylated nylon.

The third layer is an about 0.3 μm-thick charge generating layer in which a diazo pigment is dispersed in a resin material. The third layer generates a pair of positive and negative electric charges by being subjected to exposure to light. The fourth layer is a charge transporting layer, of a P-type semiconductor, formed by dispersing hydrazone in polycarbonate resin. The negative charge on the surface of the photosensitive drum 1K cannot move through the fourth layer, and the fourth layer can transport only the positive charge, generated in the charge generating layer, to the photosensitive member surface.

The fifth layer is a charge injection layer formed by coating a material obtained by dispersing $SnO_2$ ultrafine particles in an insulating resin binder containing acrylic resin as a base material. In the photosensitive drum 1K, when an organic photosensitive layer of an OPC (organic photoconductor) having a resistance value of $10^9$-$10^{14}$ Ω·cm or an amorphous silicon photosensitive layer is formed, it is possible to realize charge injection charging, so that there is an effect in preventing generation of ozone, reducing electric power consumption and improving a charging property.

(Primary Transfer Roller)

The transfer belt 5K is prepared by disposing an electroconductive foam member of $5.0\times10^6$ Ω/cm and 5.0 mm in thickness around an electroconductive metal cylinder shaft of 8 mm in diameter. The transfer roller 5K is pressed upward in the vertical direction at a total pressure of 5 kPa by springs provided at end portions thereof. A position of the transfer roller 5K is shifted by 2.5 mm from a center shaft vertical direction of the photosensitive drum 1K toward a downstream side of the intermediary transfer belt 9 with respect to the rotational direction of the intermediary transfer belt 9.

(Intermediary Transfer Belt)

As shown in FIG. 1, the intermediary transfer belt 9 is extended around and supported by a driving roller 13, a tension roller 12 and an opposite roller 10, and is rotated in an arrow R2 direction by being driven by the driving roller 13. The driving roller 13 is prepared by forming, on a core metal, an electroconductive rubber layer adjusted in resistance to $1\times10^3$-$1\times10^5\Omega$, and the core metal is grounded.

With respect to recent demands for image quality improvement, in order to realize a good transfer property of the toner image onto various species of recording materials, the intermediary transfer belt 9 employs a multi-layer structure including an elastic layer and a parting layer. By the elastic layer, an adhesive property to the recording material is enhanced, and by the parting layer, a parting property with the toner is enhanced. As a result, e.g., even in the case of a recording material having a large unevenness by being subjected to embossing, a good image can be obtained.

The intermediary transfer belt 9 has a three-layer structure. A first layer formed at an innermost surface is adjusted in resistance so as to have a surface resistivity of $1\times10^{12}$ Ω/square and a volume resistance of $1\times10^9$ Ω·cm by dispersing carbon black in a 85 μm-thick polyimide resin film. An intermediary second layer is a 250 μm-thick elastic layer principally containing a CR rubber. Also the second layer is adjusted in resistance by dispersing carbon black therein. A third layer formed at an outermost surface is an about 5 μm-thick parting layer principally containing a fluorine-containing resin material (PTFE). The parting layer improves a parting property of the toner from the intermediary transfer belt 9.

(Secondary Transfer Roller)

As shown in FIG. 1, the secondary transfer roller 11 causes the intermediary transfer belt 9 to press-contact the opposite roller 10, so that the secondary transfer portion T2 is formed between the intermediary transfer belt 9 and the secondary transfer roller 11. At the secondary transfer portion T2, the recording material P is nipped and fed while being superposed on the toner image on the intermediary transfer belt 9, and in a process in which the recording material P passes through the secondary transfer portion T2, the toner image is secondary-transferred from the intermediary transfer belt 9 onto the recording material P. A power source D2 applies a positive DC voltage to the secondary transfer roller 11, so that the toner image which is carried on the intermediary transfer belt 9 and which is negatively charged is secondary-transferred onto the recording material P.

(Black (Single Color) Image Formation)

Figure 3:
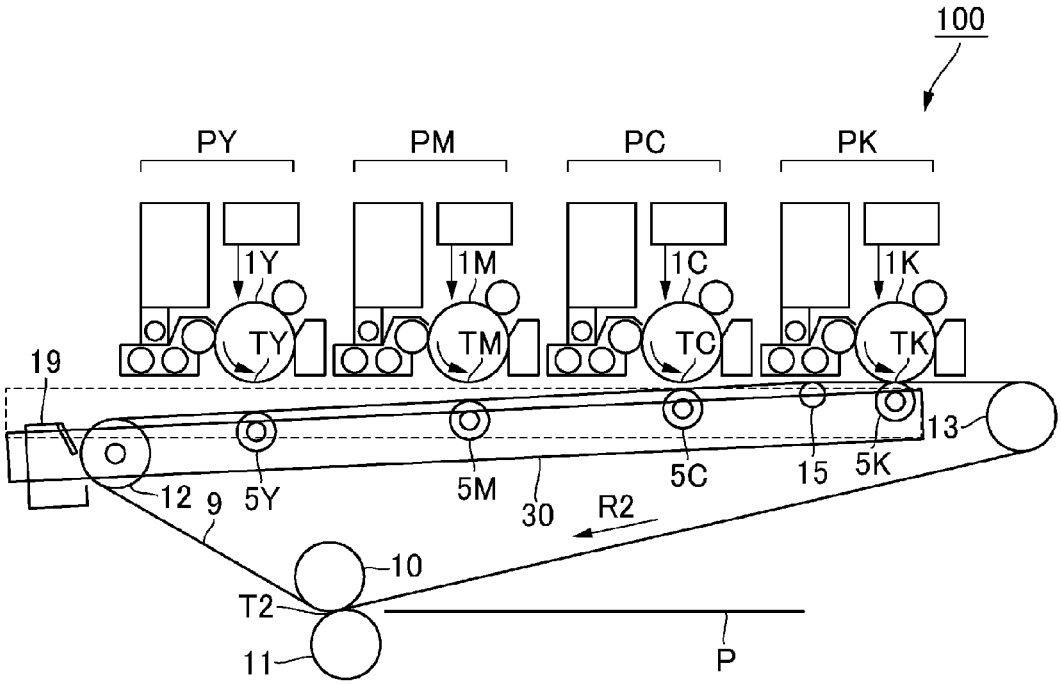
FIG. 3 is an illustration of a spaced state of photosensitive drums in black (single color) image formation.

FIG. 3 is an illustration of a spaced state of the photosensitive drums in black (single color) image formation. In the image forming apparatus 100, an output opportunity of a black (single color) image is great. In full-color image formation, an amount of the toner used is large compared with the black image formation and a frequency of maintenance of parts is also high, and therefore an output price per sheet on which the image is formed becomes high. For this reason, the output opportunity tends to be decreased. In the black image formation, an operation of the image forming portions PY, PM and PC is different from that of the image forming portions PY, PM and PC in the full-color image formation, and the photosensitive drums 1Y, 1M and 1C which are not used are spaced from the intermediary transfer belt 9.

As shown in FIG. 1, the image forming apparatus 100 is capable of executing the full-color image formation and the black image formation in a selective manner. When a full-color image forming signal is inputted, a spacing mechanism 30 raises the intermediary transfer belt 9 to bring the intermediary transfer belt 9 into contact with the photosensitive drums 1Y, 1M and 1C. The image forming apparatus 100 brings the photosensitive drums 1Y, 1M, 1C and 1K into contact with the intermediary transfer belt 9, and as described above, executes the image formation using the image forming portions PY, PM, PC and PK.

As shown in FIG. 3, when a black (single color) image forming signal is inputted, the spacing mechanism 30 lowers the intermediary transfer belt 9, and spaces (separates) the intermediary transfer belt 9 from the photosensitive drums 1Y, 1M and 1C. The image forming apparatus 100 spaces the photosensitive drums 1Y, 1M and 1C from the intermediary transfer belt 9, so that the photosensitive drum 1K is in a contact state with the intermediary transfer belt 9, and executes image formation using only the image forming portion PK.

In the black image formation, the photosensitive drums 1Y, 1M and 1C which are not used are spaced from the intermediary transfer belt 9 and are kept in a stop (rest) state. When the photosensitive drum with no development is continuously rotated in contact with the intermediary transfer belt 9, the photosensitive drum surface is abraded (worn) by friction (sliding) with the intermediary transfer belt and the cleaning blade. Further, when the photosensitive drum is continuously rotated in a state in which lubricity, by the toner, of a free end of the cleaning blade is lost, there is a possibility that the cleaning blade vibrates and that the free end of the cleaning blade is torsionally deformed.

(Spacing Mechanism)

As shown in FIG. 2, the spacing mechanism 30 is vertically rotated (moved), from a broken line position to a solid line position, about a rotation shaft of the transfer roller 5K by rotation of a cam 31 driven by a driving motor M6. The spacing mechanism 30 is provided in a pair in both sides between which the intermediary transfer belt 9 is sandwiched with respect to a direction perpendicular to the drawing sheet of FIG. 2, and integrally raises and lowers the tension roller 12, a belt cleaning device 19 and the transfer rollers 5Y, 5M and 5C. The spacing mechanism 30 bends the intermediary transfer belt 9 by a stretching roller 15, so that a portion of the intermediary transfer belt 9 upstream of the stretching roller 15 with respect to the rotational direction is lowered, and thus the intermediary transfer belt 9 is spaced from the photosensitive drums 1Y, 1M and 1C.

On an inside surface of the intermediary transfer belt 9 between the photosensitive drums 1C and 1K, the stretching roller 15 formed of aluminum is disposed and is connected to the ground potential (unshown). The stretching roller 15 contacts the intermediary transfer belt 9 in a process in which the photosensitive drums 1Y, 1M and 1C which are not subjected to the black image formation are brought into non-contact with the intermediary transfer belt 9 in the black image formation. The stretching roller 15 may preferably have an electric resistance of $1.0\times10^9\Omega$ or less. When the stretching roller 15 has the resistance of $1.0\times10^{10}\Omega$ or more, the toner image carried on the intermediary transfer belt 9 is disturbed in some cases. In the case where the image formation is continuously effected at high speed, the stretching roller 15 charges up, so that electric discharge between the stretching roller 15 and the intermediary transfer belt 9 may occur.

The stretching roller 15 is disposed superposedly on the spacing mechanism 30, and is rotatably supported at one end portion of a lever 33 rotatable about a supporting point 32 fixed to a main assembly frame of the image forming apparatus 100 (FIG. 1). At the other end portion of the lever 33, a pin 34 fixed to the spacing mechanism 30 is rotatably held. For this reason, when the pin 34 is raised and lowered by rotation (movement) of the spacing mechanism 30, the lever 33 is rotated about the supporting point 32, so that the stretching roller 15 is lowered and raised.

The stretching roller 15 is raised and lowered in interrelation with the spacing mechanism 30. The stretching roller 15 is spaced from the inside surface of the intermediary transfer belt 9 in the full-color image formation. In the black image formation, the stretching roller 15 pushes up the intermediary transfer belt 9 to a position higher than the position of the intermediary transfer belt 9 during the full-color image formation, so that a portion of the intermediary transfer belt 9 upstream of the primary transfer portion TK with respect to the rotational direction is wound about the photosensitive drum 1K in a large degree.

As described above, the image forming portion PK which is an example of a first image forming portion includes the photosensitive drum 1K which is an example of a first image bearing member and forms the toner image on the intermediary transfer belt 9 which is an example of a belt member. The image forming portion PY which is an example of a second image forming portion includes the photosensitive drum 1Y which is an example of a second image bearing member and forms the toner image on the intermediary transfer belt 9.

As described above, the spacing mechanism 30 which is an example of a switching mechanism is capable of switching two states consisting of a first state and a second state. In the first state, the photosensitive drums 1K and 1Y and the intermediary transfer belt 9 are caused to be in contact with each other. In the second state, from a state in which the photosensitive drum 1K and the intermediary transfer belt 9 are in contact with each other, the photosensitive drum 1Y and the intermediary transfer belt 9 are spaced from each other.

(Driving System)

Figure 4:
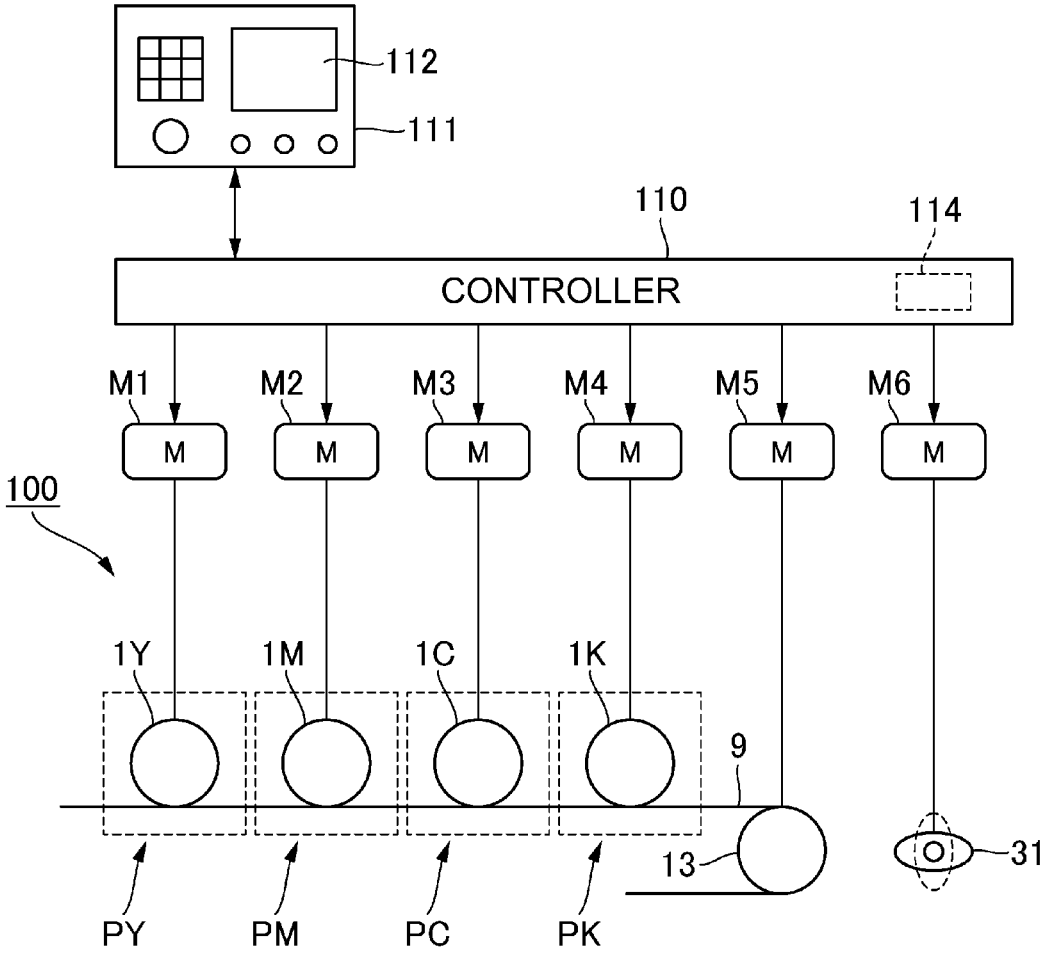
FIG. 4 is an illustration of a driving system of the image forming apparatus.

FIG. 4 is an illustration of a driving system of the image forming apparatus 100. As shown in FIG. 4, driving motors M1, M2, M3, M4 and M5 are independently speed-controlled using a DC brushless motor so that peripheral speeds of the photosensitive drums 1Y, 1M, 1C and 1K and the intermediary transfer belt 9 are kept at the above-described process speed. A driving motor M6 uses a gear motor and effects reverse rotation/stop control depending on the full-color/black image formation.

A controller 110 individually controls the driving motors M1, M2, M3, M4, M5 and M6 to actuate the photosensitive drums 1Y, 1M, 1C and 1K, the driving roller 13 and the cam 31. The photosensitive drums 1Y, 1M, 1C and 1K are individually driven by the motors M1, M2, M3 and M4, respectively.

The controller 110 executes the image formation by rotating the motors M4 and M5 in the black image formation, and maintains the motors M1, M2 and M3 in a stop (rest) state. The controller 110 actuates the motor M6 to control a rotation position of the cam 31, so that the intermediary transfer belt 9 is raised and lowered by actuating the spacing mechanism 30 as shown in FIG. 2.

An operating panel 111 displays an image on a screen 112, thus executing various settings of the image forming apparatus. A user operates the operating panel 111 and is capable of arbitrarily setting a stand-by mode for the image formation whether the stand-by is a full-color stand-by mode or a black (single color) stand-by mode.

(Stand-by Mode)

Figure 5:
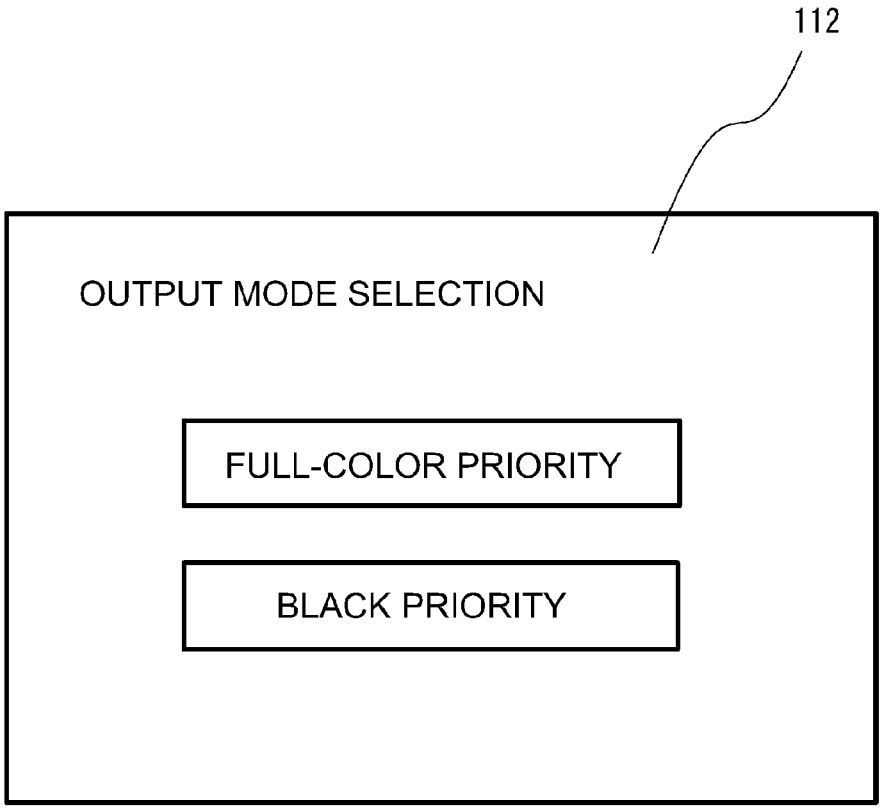
FIG. 5 is an illustration of a setting screen of a stand-by mode for image formation.

FIG. 5 is an illustration of a setting screen of the stand-by mode for the image formation. As shown in FIG. 5, when the user touches an icon of full-color image formation priority displayed on the screen 112, the full-color stand-by mode is set, and as shown in FIG. 1, the image forming apparatus 100 is on stand-by for the image formation in a state in which the image forming apparatus 100 is capable of immediately executing an operation in a full-color mode. In the case where the full-color image formation is effected in many instances, it is possible to shorten an output time of a color print by setting the stand-by mode at the full-color stand-by mode.

As shown in FIG. 5, when the user touches an icon of black (single color) image formation displayed on the screen 112, the black stand-by mode is set. As shown in FIG. 3, the image forming apparatus 100 is on stand-by for the image formation in a state in which the image forming apparatus 100 is capable of immediately executing the black image formation. In the case where the black image formation is effected in many instances, it is possible to shorten an output time of a monochromatic print.

However, as shown in Table 1 below, when the full-color stand-by mode is set, it takes much time to start the black image formation, and therefore the output time of the monochromatic print becomes long. Similarly, when the black stand-by mode is set, it takes much time to start the full-color image formation, and therefore the output time of the color print becomes long.

TABLE 1

| | Output time | |
|---|---|---|
| Stand-by mode setting | Full-color | Black |
| Full-color | 7.9 sec | 7.6 sec |
| Black | 8.7 sec | 6.8 sec |

As described above, the controller 110 which is an example of a setting portion is capable of setting the full-color stand-by mode which is an example of a first stand-by mode and the black stand-by mode which is an example of a second stand-by mode through the operating panel 111. In the full-color stand-by mode, the image forming apparatus 100 is on stand-by for the image formation in the first state, so that a convenience to the user who performs the full-color image formation at a high frequency is provided. In the black stand-by mode, the image forming apparatus 100 is on stand-by for the image formation in the second state, so that a convenience to the user who performs the black image formation at a high frequency is provided.

(Photosensitive Drum Memory)

Figure 6:
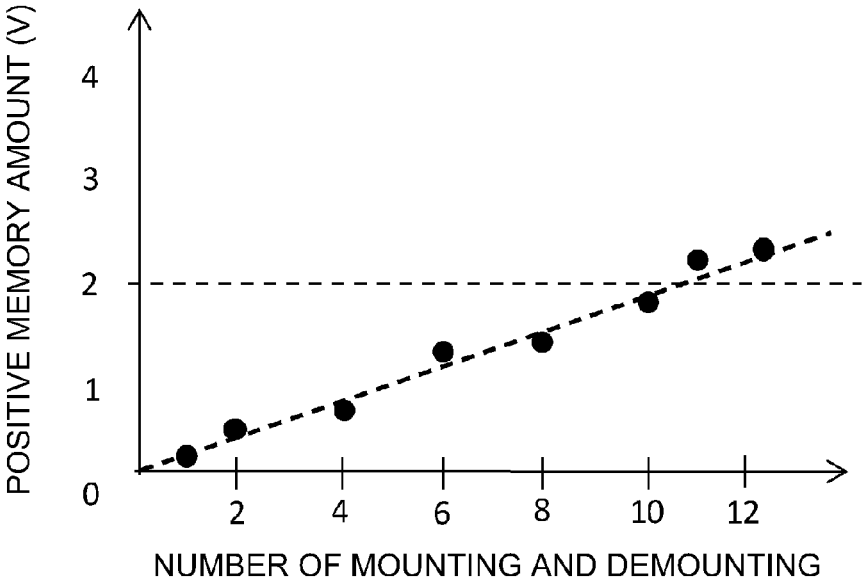
FIG. 6 is a graph showing a relationship between the number of mounting and demounting of the photosensitive drum and a positive memory amount of the photosensitive drum.

FIG. 6 is a graph showing a relationship between the number of mounting and demounting of the photosensitive drum and an amount of photosensitive drum memory. In the case where the black image formation in the operation in the full-color stand-by mode is executed, the image formation is executed by changing the state from a contact state of the intermediary transfer belt 9 with all the photosensitive drums 1Y, 1M, 1C and 1K to a contact state of the intermediary transfer belt 9 with only the photosensitive drum 1K. Then, after the image formation, the state is returned to the contact state of the intermediary transfer belt 9 with all the photosensitive drums 1Y, 1M, 1C and 1K. When such an operation is repetitively executed, it was confirmed that at a contact portion of the intermediary transfer belt 9 with each of the photosensitive drums 1Y, 1M and 1C, other than the photosensitive drum 1K, which are not subjected to the image formation, memory due to friction generates.

As shown in FIG. 5, contact and spacing (separation) of the intermediary transfer belt 9 relative to the photosensitive drums 1Y, 1M and 1C during the stand-by for the printing can be arbitrarily set by selecting the full-color stand-by mode/black stand-by mode by the user.

When the black image formation is successively executed plural times while interposing the stand-by state in an environment of setting of the full-color stand-by mode, electrostatic memory due to local charging appears at a contact position of the intermediary transfer belt 9 with each of the photosensitive drums 1Y, 1M and 1C. The local charging appearing as the electrostatic memory is referred to as positive memory since the local charging in Embodiment 1 is positive in polarity.

When the full-color image is outputted using the photosensitive drums 1Y, 1M and 1C on which the positive memory appears, the positive memory is developed with the toner, so that a line-shaped toner image extending in a direction perpendicular to a recording material feeding direction appears on a fixed image. The line-shaped toner image obtained by development of the positive memory impairs density uniformity of the fixed image and thus lowers an image quality with reliability.

The positive memory is generated by triboelectric charge (contact charging) between the intermediary transfer belt surface and the surface of each of the photosensitive drums 1Y, 1M and 1C. As described above, the surface of each of the photosensitive drums 1Y, 1M and 1C principally contains acrylic resin, and the surface of the intermediary transfer belt 9 is coated with the parting layer principally containing the fluorine-containing resin material.

TABLE 2

| | | |
|---|---|---|
| CHARGEABLE | ASBESTOS | MOST POSITIVELY |
| | HUMAN HAIR, FUR | CHRGED(+) |
| | GLASS | |
| | MICA | |
| | WOOL | |
| | NYLON | |
| | RAYON | |
| | LEAD | |
| | SILK | |
| | COTTON | |
| | HEMP | |
| | WOOD | |
| | HUMAN SKIN | |
| | GLASS FIBER | |
| LESS | ZINC | |
| CHARGEABLE | ACETATE | |
| | ALUMINUM | |
| | PAPER | |
| | CHROMIUM | |
| | EBONITE | |
| | IRON | |
| | COPPER | |
| | NICKEL | |
| | GOLD | |
| | RUBBER | |
| | POLYSTYLENE | |
| | PLATINUM | |
| | POLYPROPYLENE | |
| | POLYESTER | |
| | ACRYLIC | |
| | POLYETHYLENE | |
| | CELLULOID | |
| | CELLOPHANE | |
| | POLYVINYL CHLORIDE | MOST NEGATIVELY |
| CHRGEABLE | TEFLON | CHRGED(−) |

As shown in Table 2, when materials different in degree (amount/polarity) of charging tendency are contacted to each other, charging generates. When the acrylic resin having a weak (small) negative charging tendency and the fluorine-containing resin material having a strong (large) negative charging tendency are contacted to each other, the acrylic resin is positively charged, and the fluorine-containing resin material is negatively charged.

When the black image formation is executed in the operation in the full-color stand-by mode, the photosensitive drums 1Y, 1M and 1C are spaced from the intermediary transfer belt 9, and after the image formation is executed, are contacted again to the intermediary transfer belt 9. During the period, the photosensitive drums 1Y, 1M and 1C are not rotated, and therefore each of the photosensitive drums 1Y, 1M and 1C contacts the intermediary transfer belt 9 with the same phase angle, so that a degree of the charging is added. When this operation is continuously performed, each of the photosensitive drums 1Y, 1M and 1C is contacted to and spaced from the intermediary transfer belt 9 always at the same portion, so that a degree of local charging is strengthened.

As shown in FIG. 6, as the number of mounting (contact) and demounting (separation) of each of the photosensitive drums 1Y, 1M and 1C relative to the intermediary transfer belt 9 increases, a potential of the positive memory amount becomes high. It is confirmed that the number of mounting and demounting and an accumulated amount of the electrostatic memory (positive memory) are in a proportional relation. Incidentally, at a photosensitive drum contact portion of the intermediary transfer belt 9, negative memory opposite in polarity to the positive memory of each of the photosensitive drums 1Y, 1M and 1C generates, but the intermediary transfer belt 9 rotates when the image formation is effected, and therefore the intermediary transfer belt 9 is prevented from outputting each of the photosensitive drums 1Y, 1M and 1C at the same portion (position).

Therefore, in this embodiment and the subsequent embodiments, when the black image formation is executed in the full-color stand-by mode, each of the photosensitive drums 1Y, 1M and 1C is somewhat rotated, so that a contact position thereof with the intermediary transfer belt 9 is shifted. As a result, such a toner image that the positive memory appears to become conspicuous is prevented from being formed on each of the photosensitive drums 1Y, 1M and 1C through the development. Even when the black image formation is executed in the full-color stand-by mode, a good full-color image is capable of being outputted.

(Operation Sequence)

Figure 7:
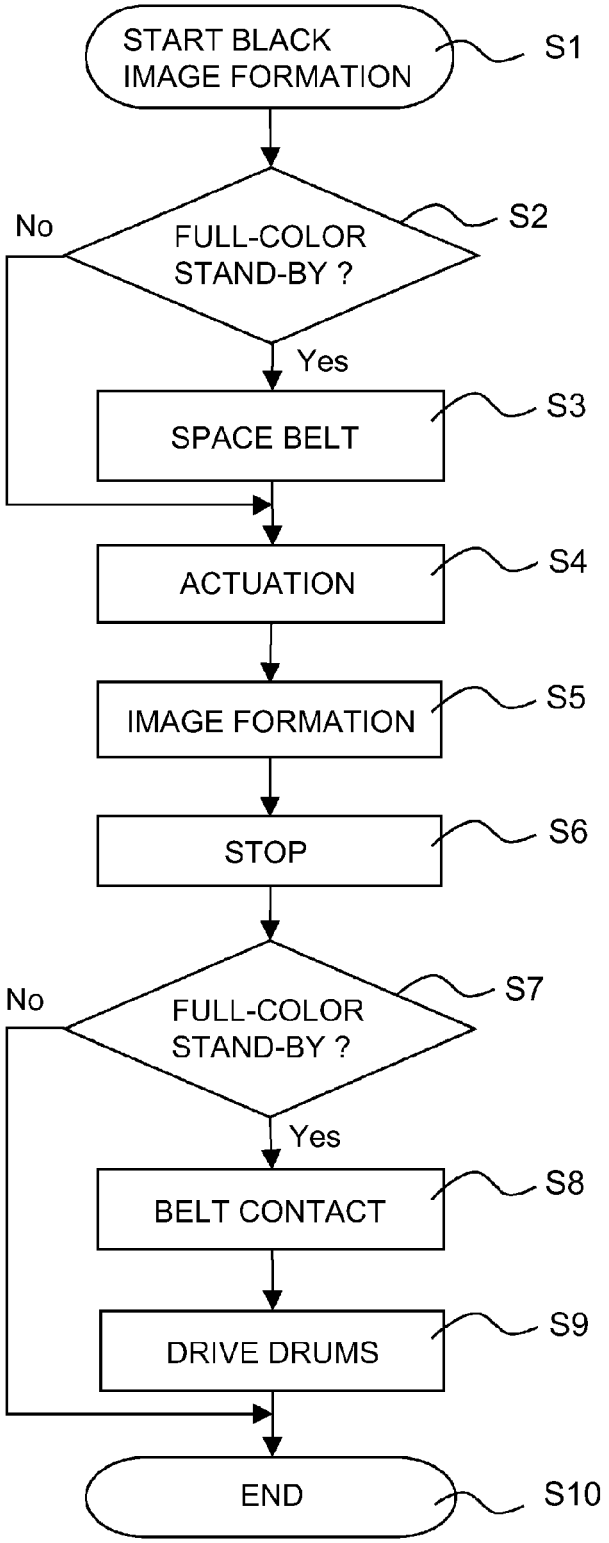
FIG. 7 is a flowchart of black (single color) image formation in Embodiment 1.

FIG. 7 is a flowchart of the black image formation in Embodiment 1. As shown in FIG. 7 with reference to FIG. 4, the image forming apparatus 100 executes the black image formation.

When the controller 110 receives black (single color) image formation print data sent from an unshown input terminal, the controller 110 starts the black image formation (S1). The controller discriminates whether a set mode during current stand-by is the full-color stand-by mode or the black stand-by mode (S2).

In the case where the set mode during the stand-by is the black stand-by mode (No of S2), the controller 110 operates the driving motors M4 and M5 to start actuation of the image forming apparatus (S4). In the case where the set mode during the stand-by is the full-color stand-by mode (Yes of S2), the controller operates the driving motor M6 to space (separate) the intermediary transfer belt 9 from the photosensitive drums 1Y, 1M and 1C (S3).

The controller 110 actuates the driving motors M4 and M5 to start actuation of the image forming apparatus 100 (S4). After the actuation, the above-described image forming step is performed, so that the image is outputted (S5). After the output of the image, the controller stops the driving motors M4 and M5, and then the operation of the image forming apparatus 100 is stopped (S6).

After the operation of the image forming apparatus 100, the controller discriminates whether the set mode during the stand-by is the full-color stand-by mode or the black stand-by mode (S7). In the case where the set mode during the stand-by is the black stand-by mode (No of S7), the sequence is ended (S10). In the case where the set mode during the stand-by is the full-color stand-by mode (Yes of S7), the controller 110 actuates the driving motor M4 to cause the intermediary transfer belt 9 to contact the photosensitive drums 1Y, 1M and 1C, and then the stand-by mode is returned to the full-color stand-by mode (S8). The controller 110 operates the driving motors M1, M2, M3, M4 and M5 for a short time in the state in which the intermediary transfer belt 9 is contacted to the photosensitive drums 1Y, 1M and 1C, so that the photosensitive drums 1Y, 1M and 1C are rotated by 50 degrees as a predetermined angle in the same direction as the rotational direction thereof during the image formation (S9).

The predetermined angle is not limited to 50 degrees, but may desirably be a value which is not an integral submultiple of 360 degrees. This is because when the black image formation is repetitively effected plural times, the positive memory region is prevented from contacting the intermediary transfer belt 9 again. Further, the rotational direction may also be opposite to the rotational direction during the image formation.

Through the above-described steps, the image forming apparatus 100 is placed in a stand-by state for subsequent image formation (S10).

(Effect of Embodiment 1)

In Embodiment 1, the controller 110 which is an example of the controller rotates the photosensitive drum 1Y by a predetermined amount in the case where the image formation in the second state is repetitively executed during the setting of the full-color stand-by mode. As a result, the influence of the generation of the drum memory on the image formation is avoided.

Specifically, after the intermediary transfer belt 9 is spaced from the photosensitive drums 1Y, 1M and 1C and then the black image forming job is executed, the photosensitive drums 1Y, 1M and 1C which are not used for the image formation are rotated by a small angle. By rotating the photosensitive drum 1Y by a predetermined amount at timing of a predetermined number (one) of repetition, a contact position of the photosensitive drum 1Y with the intermediary transfer belt 9 after current image formation differs from a contact position of the photosensitive drum 1Y with the intermediary transfer belt 9 after last (preceding) image formation. Formation of the local positive memory due to repetition of the memory (contact) and demounting (separation) of the intermediary transfer belt 9 relative to the photosensitive drums 1Y, 1M and 1C at the same phase position is avoided.

As a result, even when in a state in which the full-color stand-by mode is set, the black image forming job is continuously or intermittently executed plural times, it is possible to output a good image avoiding the influence of the positive memory. The image defect due to the positive memory of the photosensitive drums 1Y, 1M and 1C does not generate.

On the other hand, in the case where the full-color image formation is effected in the full-color stand-by mode, image formation by the image forming portions PY, PM, PC and PK is executed in a state in which the photosensitive drum 1Y is contacted to the intermediary transfer belt 9 and then is kept in the contact state. When the full-color image formation is executed, the photosensitive drums 1Y, 1M and 1C rotate, so that the positive memory does not generate, and therefore the photosensitive drum 1Y is not rotated in the predetermined amount. Further, in the black stand-by mode, the image forming apparatus is on stand-by for subsequent image formation in a state in which the photosensitive drum 1Y is spaced from the intermediary transfer belt 9 after the image formation is executed. In the black stand-by mode, each of the photosensitive drums 1Y, 1M, 1C and 1K does not repetitively contact the intermediary transfer belt 9 at the same position, and therefore there is no need to rotate the photosensitive drum 1Y in the predetermined amount.

In this embodiment, after the image formation in the second state during the full-color stand-by mode is ended, the intermediary transfer belt 9 is contacted to the photosensitive drum 1Y and then the photosensitive drum 1Y is rotated in the predetermined amount. Therefore, the positive memory generating when the photosensitive drum 1Y is rotated in the predetermined amount is prevented from having the influence on subsequent image formation. In this case, the intermediary transfer belt 9 and the photosensitive drum 1Y are rotated together in the contact state, so that it is possible to avoid unnecessary friction between the intermediary transfer belt 9 and the photosensitive drum 1Y.

In this embodiment, after the black image formation during the full-color stand-by mode is ended, until the subsequent image formation is started in a state in which the photosensitive drum 1Y is on stand-by, the photosensitive drum 1Y is rotated in the predetermined amount. Therefore, a time required for rotating the photosensitive drum 1Y in the predetermined amount does not delay the start of the black image formation.

In this embodiment, the rotation in the predetermined amount is the rotation by an angle of rotation other than the integral submultiple of 360 degrees. For this reason, when the photosensitive drum 1Y rotates through one full circumference by repetition of the rotation in the predetermined amount, the contact position of the photosensitive drum 1Y with the intermediary transfer belt 9 does not overlap with the original contact position.

In this embodiment, the predetermined amount for rotation is an angle of rotation of 10 degrees or more and 80 degrees or less. Below 10 degrees, there is a possibility that a part of a contact range of the photosensitive drum 1Y with the intermediary transfer belt 9 overlaps with the original contact range and therefore the angle of rotation of below 10 degrees is excessively small. The angle of rotation of above 80 degrees is excessive for the purpose of suppressing the positive memory.

Modified Embodiments of Embodiment 1

The present invention can also be carried out also in the embodiments in which a part or all of constituent elements in Embodiment 1 described above and Embodiments 2 and 3 described later are replaced with alternative constituent elements thereof. In Embodiment 1, only a principal portion relating to the toner image formation and transfer was described, but the present invention can be carried out in various uses including printers, various printing machines, copying machines, facsimile machines, multi-function machines and so on by adding necessary device, equipment and casing structure.

In Embodiment 1, after the black image formation was ended, the intermediary transfer belt 9 was contacted to all the photosensitive drums 1Y, 1M, 1C and 1K and then the photosensitive drums 1Y, 1M, 1C and 1K were rotated by the small angle. However, after the black image formation is ended, before the intermediary transfer belt 9 is contacted to all the photosensitive drums 1Y, 1M, 1C and 1K, only the photosensitive drums 1Y, 1M and 1C may also be rotated by the small angle. That is, after the image formation in the second state during the full-color stand-by mode is ended, the photosensitive drum 1Y may also be rotated in the predetermined amount before the intermediary transfer belt 9 is contacted to the photosensitive drum 1Y.

Or, after the black image formation data is received, the rotation of the intermediary transfer belt 9 and the photosensitive drums 1Y, 1M, 1C and 1K may also be started at the same timing before the intermediary transfer belt 9 is spaced from the photosensitive drums 1Y, 1M and 1C. Or, when the image formation is executed using the photosensitive drum 1K in a state in which the intermediary transfer belt 9 is spaced from the photosensitive drums 1Y, 1M and 1C, the photosensitive drums 1Y, 1M, 1C and 1K in the spaced state from the intermediary transfer belt 9 may also be rotated by the small angle.

Further, in Embodiment 1, the photosensitive drums 1Y, 1M and 1C were rotated by the small angle. However, by rotating the photosensitive drums 1Y, 1M and 1C by the small angle, the positive memory on the photosensitive drums 1Y, 1M and 1C may also be gradually caused too disappear. However, it takes much contact time, and therefore there is a liability that a lowering in productivity is caused.

Further, in Embodiment 1, the intermediary transfer belt 9 was moved and spaced from the photosensitive drums 1Y, 1M and 1C, but as disclosed in Japanese Laid-Open Patent Application 2003-043770, the spacing mechanism may also be constituted so that the photosensitive drums 1Y, 1M and 1C are moved and spaced from the intermediary transfer belt 9.

Embodiment 2

Figure 8:
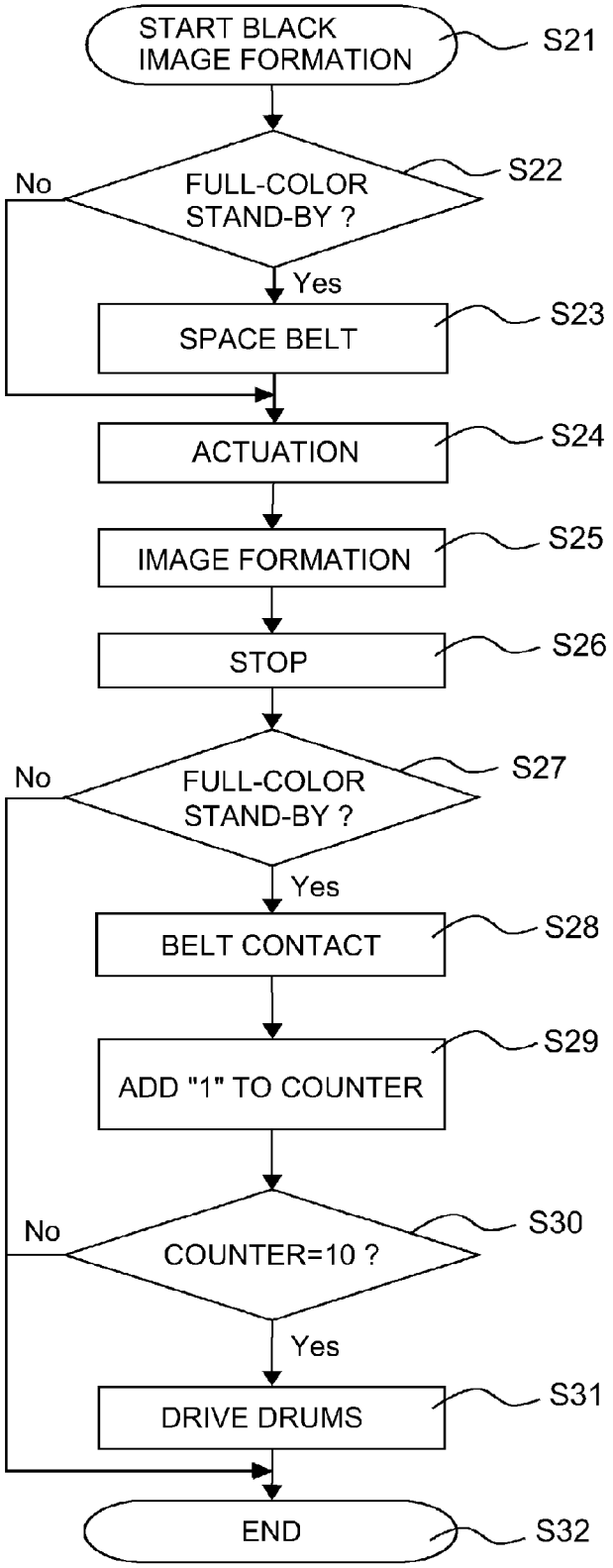
FIG. 8 is a flowchart of black (single color) image formation in Embodiment 2.

FIG. 8 is a flowchart of black (single color) image formation in Embodiment 2. In Embodiment 1, when the black image formation was executed, the photosensitive drums 1Y, 1M and 1C were rotated every time in the same direction as that during the image formation by 50 degrees. On the other hand, in Embodiment 2, until the positive memory amount is a value close to 2V, even when black image formation is executed, the photosensitive drums 1Y, 1M and 1C are not rotated in the same direction as that during the image formation by 50 degrees. In this embodiment, control is made so that an accumulation amount of the positive memory due to the friction of the intermediary transfer belt 9 with the photosensitive drums 1Y, 1M and 1C is 2V or less.

Embodiment 2 is similarly constituted and controlled as in Embodiment 1 except for the above point, and therefore steps common to Embodiments 1 and 2 are represented by the same reference symbols and will be omitted from redundant description.

As shown in FIG. 6, the positive memory does not exceed 2V when the number of continuous mounting (contact) and demounting (separation) between the intermediary transfer belt 9 and the photosensitive drum 1Y, 1M and 1K by execution of the black image formation is 10 times or less. For this reason, in this embodiment, at the time when the number of continuous mounting and demounting reaches 10 times, the photosensitive drums 1Y, 1M and 1C are rotated in the same direction as that during the image formation by 50 degrees, so that the accumulation of the positive memory of 2V or more is prevented.

The reason why a limit of the positive memory is 2V is that when a half-tone image is outputted, in subsequent image formation, a difference in reflection density between a portion where the positive memory generates and a portion where the positive memory does not generate is 0.01 or less, and therefore the difference is such an amount that the positive memory is little recognizable by the naked eye. For measurement of the difference in reflection density, a reflection densitometer ("Model 504", manufactured by X-Rite Inc.) was used.

In this embodiment, a reference value of the positive memory was 2V, but is not limited thereto. The reference value may also be larger than or smaller than 2V depending on a degree of the influence on the image property.

As shown in FIG. 4, the controller 10 is provided with a black (single color) image formation counter 114. The black image formation counter 114 holds an integrated value of the number of times of continuous execution of the black image formation in a state in which the image forming apparatus 100 is set at the full-color stand-by mode.

As shown in FIG. 8 with reference to FIG. 4, control from a step of receiving print data for the black image formation (S21) to a step of bringing the intermediary transfer belt 9 into contact with the photosensitive drums 1Y, 1M, 1C and 1K (S28) via a step of forming the image (S25) is similar to that in Embodiment 1.

After the intermediary transfer belt 9 is contacted to the photosensitive drums 1Y, 1M, 1C and 1K (S28), the controller 110 adds "1" to a count by the black image formation counter 114 (S29).

The controller 110 discriminates whether or not the number of integrated times of the black image formation counter 114 reaches "10" (S30).

When, the count by the black image formation counter 114 does not reach "10", the controller 110 ends the sequence (S32).

When the count by the black image formation counter 114 reaches "10", the controller 110 rotates the photosensitive drums 1Y, 1M, 1C and 1K by 50 degrees in the contact state with the intermediary transfer belt 9 (S31).

Through the above-described steps, the image forming apparatus 100 is in a stand-by state for subsequent image formation (S32).

In this embodiment, during the full-color stand-by mode, in the case where the number of times of continuous repetitive execution of the image formation in the second state reaches the predetermined number of times of two or more, the photosensitive drum 1Y is rotated in the predetermined amount. As a result, a frequency of the rotation in the predetermined amount is lowered compared with the case where the photosensitive drum 1Y is rotated in the predetermined amount every execution of the image formation in the second state, so that electric power consumption and a contact time can be saved.

In this embodiment, during continuous or intermittent black image formation under setting of the full-color stand-by mode, the photosensitive drums 1Y, 1M and 1C are rotated in the predetermined amount when the number of times of continuous contact of the intermediary transfer belt 9 with the photosensitive drums 1Y, 1M and 1C reaches the predetermined number of times. As a result, under the setting of the full-color stand-by mode, even when the black image formation is repetitively executed, the image defect due to the positive memory of the photosensitive drums 1Y, 1M and 1C does not generate. In addition, compared with Embodiment 1, the frequency of the rotation of the photosensitive drums 1Y, 1M, 1C and 1K by 50 degrees is small, and therefore the electric power consumption is saved, and also a degree of abrasion of the photosensitive drums 1Y, 1M and 1C is small. Also unnecessary deterioration of the developers by stirring in the developing devices 4Y, 4M and 4C driven together with the photosensitive drums 1Y, 1M and 1C is suppressed.

Embodiment 3

Figure 9:
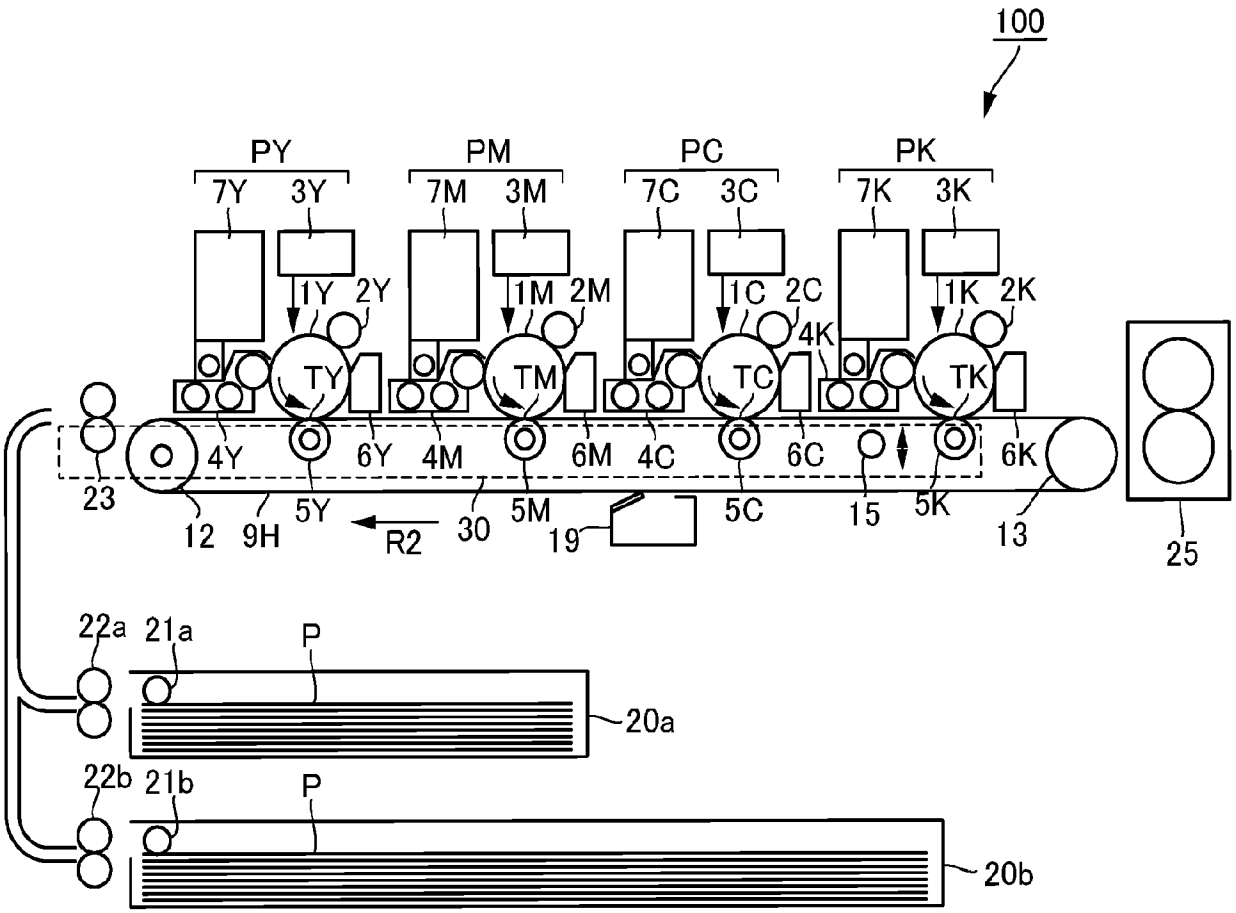
FIG. 9 is an illustration of a structure of an image forming apparatus in Embodiment 3.

FIG. 9 is an illustration of a structure of an image forming apparatus in Embodiment 3.

In Embodiments 1 and 2, the image forming apparatus using the intermediary transfer belt was described. However, the present invention is not limited to the image forming apparatus of the intermediary transfer type, but can also be carried out in an image forming apparatus in which the toner image is transferred onto the recording material carried on a recording material feeding belt.

As shown in FIG. 9, the image forming portion PK which is an example of the first image forming portion transfers the toner image from the photosensitive drum 1K onto the recording material carried on a recording material feeding belt 9H. The image forming portion PY which is an example of the second image forming portion transfers the toner image from the photosensitive drum 1Y onto the recording material carried on the recording material feeding belt 9H.

Other constitutions are the same as those in Embodiment 1, and therefore constituent elements common to FIG. 1 of Embodiment 1 and FIG. 9 of Embodiment 2 are represented by the same reference numerals or symbols and will be omitted from redundant description.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-103975 filed on May 20, 2014, which is hereby incorporated by reference herein in its entirety.

What is claimed is:

1. An image forming apparatus comprising:

a movable belt member;

a first image forming unit, including a rotatable first image bearing drum, for forming a toner image on said belt member;

a second image forming unit, including a rotatable second image bearing drum, for forming a toner image on said belt member;

a contact and separation portion capable of setting one of a plurality of states including a first state in which said belt member is in contact with the first and second image bearing drums and a second state in which said belt member is in contact with the first image bearing drum and is in separation from the second image bearing drum;

an executing portion capable of executing an image forming operation in a mode in which when image data is received, the second state is set and in a state in which the second image bearing drum is at rest, the toner image is formed on said belt member by said first image forming unit and then is transferred onto a recording material; and a controller for rotating the second image bearing drum by a predetermined angle so that when a cycle of an operation is to be repeated N times which is not less than 1, a position of the second image bearing drum which is in contact with said belt member in an (N−1)th cycle differs from a position of the second image bearing drum which is in contact with said belt member in an Nth cycle, the cycle including receiving the image data in a state in which said belt member and the first and second image bearing drums are at rest and in a stand-by state in which said image forming apparatus waits for an input of the image data in the first state, executing the image forming operation, and then returning said image forming apparatus to the stand-by state.

2. An image forming apparatus according to claim 1, wherein the predetermined angle is less than 360 degrees.

3. An image forming apparatus according to claim 1, wherein the predetermined angle is a value other than an integral submultiple of 360 degrees.

4. An image forming apparatus according to claim 1, wherein the predetermined angle is 10 degrees or more and 80 degrees or less.

5. An image forming apparatus according to claim 2, wherein the predetermined angle is larger than a contact range between the second image bearing drum and said belt member in the first state with respect to a rotational direction of the second image bearing drum.

6. An image forming apparatus according to claim 1, wherein after the image formation is effected in the second state, said controller rotates the second image bearing drum by the predetermined angle after contact between said belt member and the second image bearing drum.

7. An image forming apparatus according to claim 1, wherein after the image formation is effected in the second state, said controller rotates the second image bearing drum by the predetermined angle before contact between said belt member and the second image bearing drum.

8. An image forming apparatus according to claim 1, wherein said controller rotates the second image bearing member by the predetermined angle at timing other than during execution of the image formation in the Nth cycle.

9. An image forming apparatus according to claim 1, wherein said controller rotates the second image bearing drum by the predetermined angle after the image data is inputted and before separation between said belt member and the second image bearing drum.

10. An image forming apparatus according to claim 1, wherein said controller rotates the second image bearing drum by the predetermined angle after separation between said belt member and the second image bearing drum and before the image formation is started.

11. An image forming apparatus according to claim 1, wherein said belt member has a plurality of layers, and of the layers, the layer contactable to the first and second image bearing drums contains a fluorine-containing resin component.

12. An image forming apparatus according to claim 1, wherein each of the first and second image bearing drums has a plurality of layers, and of the layers, the layer contactable to said belt member contains an acrylic resin component.

13. An image forming apparatus according to claim 1, wherein a triboelectric series of a material for a surface of each of the first and second image bearing drums relative to a material for a surface of said belt member is of the same polarity as a toner charge polarity.

14. An image forming apparatus comprising:

a movable belt member for feeding a recording material;

a first image forming unit, including a rotatable first image bearing drum, for forming a toner image on the recording material fed to said belt member;

a second image forming unit, including a rotatable second image bearing drum, for forming a toner image on the recording material fed to said belt member;

a contact-and-separation portion capable of setting one of a plurality of states including a first state in which said belt member is in contact with the first and second image bearing drums and a second state in which said belt member is in contact with the first image bearing drum and is in separation from the second image bearing drum;

an executing portion capable of executing an operation in a mode in which when image data is received, the second state is set and in a state in which the second image bearing drum is at rest, the toner image is formed on the recording material fed to said belt member by said first image forming unit and then is transferred onto the recording material; and a controller for rotating the second image bearing drum by a predetermined angle so that when a cycle of an operation is to be repeated N times which is not less than 1, a position of the second image bearing drum which is in contact with said belt member in an (N−1)th cycle differs from a position of the second image bearing drum which is in contact with said belt member in an Nth cycle, the cycle including receiving the image data in a state in which said belt member and the first and second image bearing drums are at rest and in a stand-by state in which said image forming apparatus waits for an input of the image data in the first state, executing the image forming operation, and then returning said image forming apparatus to the stand-by state.

* * * * *